US006283549B1

(12) United States Patent
Husemann

(10) Patent No.: US 6,283,549 B1
(45) Date of Patent: Sep. 4, 2001

(54) OFFICE CHAIR WITH A SEAT TILT ADJUSTMENT

(75) Inventor: Dirk Husemann, Bad Essen (DE)

(73) Assignee: Drabert GmbH, Minden (DE)

( * ) Notice: Subject to any disclaimer, the term of this patent is extended or adjusted under 35 U.S.C. 154(b) by 0 days.

(21) Appl. No.: 09/422,488

(22) Filed: Oct. 21, 1999

(30) Foreign Application Priority Data

Oct. 21, 1998 (DE) ..... 198 49 522

(51) Int. Cl.[7] ..... A47C 1/02
(52) U.S. Cl. ..... 297/325; 297/300.8; 297/301.7
(58) Field of Search ..... 297/325, 302.4, 297/302.7, 300.8, 301.7, 320, 322, 326

(56) References Cited

U.S. PATENT DOCUMENTS 4,077,596 * 3/1978 Pinaire et al. ..... 297/302.7 X
4,537,445 * 8/1985 Neuhoff ..... 297/300.8 X
4,818,020 * 4/1989 Meiller et al. ..... 297/300.8 X
4,889,384 * 12/1989 Sulzer ..... 297/302.7 X
4,909,472 * 3/1990 Piretti ..... 297/302.4 X
5,280,998 * 1/1994 Miotto et al. ..... 297/302.4
5,762,399 * 6/1998 Liu ..... 297/300.8 X

FOREIGN PATENT DOCUMENTS 29 02 622 A1 7/1980 (DE) .

* cited by examiner

*Primary Examiner*—Peter M. Cuomo
*Assistant Examiner*—Stephen Vu
(74) *Attorney, Agent, or Firm*—Salter & Michaelson

(57) ABSTRACT

An office chair is provided. The office chair includes an eccentric adjustment of the tilt of the seat surface. In order to prevent against undesired tilt adjustments, it is provided to use a rotating shaft with a manipulation part and a functional part for the eccentric adjustment and to control a disengageable locking catch, which blocks any rotating angle adjustment of the functional part of the rotating shaft in the non-disengaged state by the manipulation part in a first rotating angle region.

4 Claims, 2 Drawing Sheets

OFFICE CHAIR WITH A SEAT TILT ADJUSTMENT

DESCRIPTION

1. Technical Field

The invention concerns an office chair with a seat or bearing surface carrier, which is mounted in a tilt-adjustable manner around a horizontal and crosswise running axis in a supporting frame, whereby the tilt adjustment is produced by means of an eccentric rotating shaft which is mounted with at least one concentric shaft part in a pivot bearing of the supporting frame and which has at least one eccentric shaft part (cam), which runs in a cam bearing of the seat carrier such that a rotating angular adjustment of the rotating shaft conducted by a person seated in the seat changes the tilt of the seat carrier relative to the supporting frame.

2. Background of Related Art

Such cam adjustments are known for a seat tilt adjustment of office chairs. They can be actuated as a rule independently of other possible adjustments of the office chair and also independently of a synchronous mechanism for the office chair that may be present.

Cam adjustments are self-locking within certain limits, i.e., they do not change their rotating angle position after it is set by the person seated in the seat. However, this no longer applies if the cams, which are positioned in a cam bearing of the seat carrier, are loaded with a body weight of the person seated in the seat that is too great, or if there is too strong a dynamic behavior of the person seated in the seat which causes, for example, vibrations of the cam bearing. This can lead to undesired displacements of the seat tilt.

There is therefore need in the art an office chair of the above-named type with a tilt adjustment of the seating surface in such a way that undesired displacements of the seat tilt cannot occur.

SUMMARY

In accordance with the present invention, there is provided a rotating shaft which has a manipulation part, that can be rotated relative to the functional part of the rotating shaft, and that between the functional part of the rotating shaft and the supporting frame, a disengageable locking catch is present. The locking catch disengages the rotating angle displacement of the functional part in the non-disengaged state, whereby a first rotating angle region of the rotating angle adjustment conducted by the person seated in the seat on the manipulation part of the rotating shaft is converted into a disengaging motion of the locking catch by means of a change-over drive. A subsequent second rotating angle region of the rotating angle adjustment conducted by the person seated on the seat on the manipulation part of the rotating shaft causes an analogous rotating angle adjustment of the functional part of the rotating shaft by means of a catch piece between the manipulation part and the functional part of the rotating shaft.

An office chair manufactured according to the teaching of the invention has the advantage that its user-friendliness remains during the adjustment of the seat tilt. The person seated in the seat actuates, as previously, only one rotating shaft and in this way adjusts the seat tilt in the desired way. The transition between the first and second rotating angle regions of the rotating shaft defined according to the above-given teaching of the invention remains unknown and unnoticed by the person seated in the seat in the normal case, since the rotating angle regions of the rotating shaft that continually follow one another concern only internal functional courses.

In the first rotating angle region, a locking catch is unlocked, i.e. disengaged, which is permanently engaged unless there is an actuation of the rotating shaft and in this way any undesired displacement of the cam or cams of the rotating shaft, whose respective eccentric throw determines the seat tilt, is effectively prevented.

In the second rotating angle region, the locking catch is then disengaged, so that the respective eccentric throw can be adjusted by means of a catch piece in this rotating angle region.

In one embodiment, the locking catch is shaped in the form of a toothed-wheel gearing sitting on the functional part of the rotating shaft and resistant to rotation, which is engaged in the non-disengaged state with a toothed-wheel gearing attached in a stationary manner on the supporting frame, whereby the toothed-wheel gearing sitting on the functional part of the rotating shaft can be disengaged by an axial displacement movement on the rotating shaft against the pressure of a locking spring. Such a locking catch between the functional part of the rotating shaft and the supporting frame can be manufactured in a simple and cost-favorable manner.

This applies also to the change-over drive, which changes the rotating motion of the manipulation part of the rotating shaft in the first rotating angle region into an axial disengagement motion of the locking catch. In one embodiment, the change-over drive includes one or more starting bevels, which are arranged on the bearing surfaces of the manipulation part and the functional part of the rotating shaft on the front side lying opposite one another.

These starting bevels may be formed the same in both directions of rotation of the rotating shaft, so that the person seated in the seat can rotate the rotating shaft selectively in one or the other direction of rotation and always reach his desired objective of a tilt adjustment of the seat.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
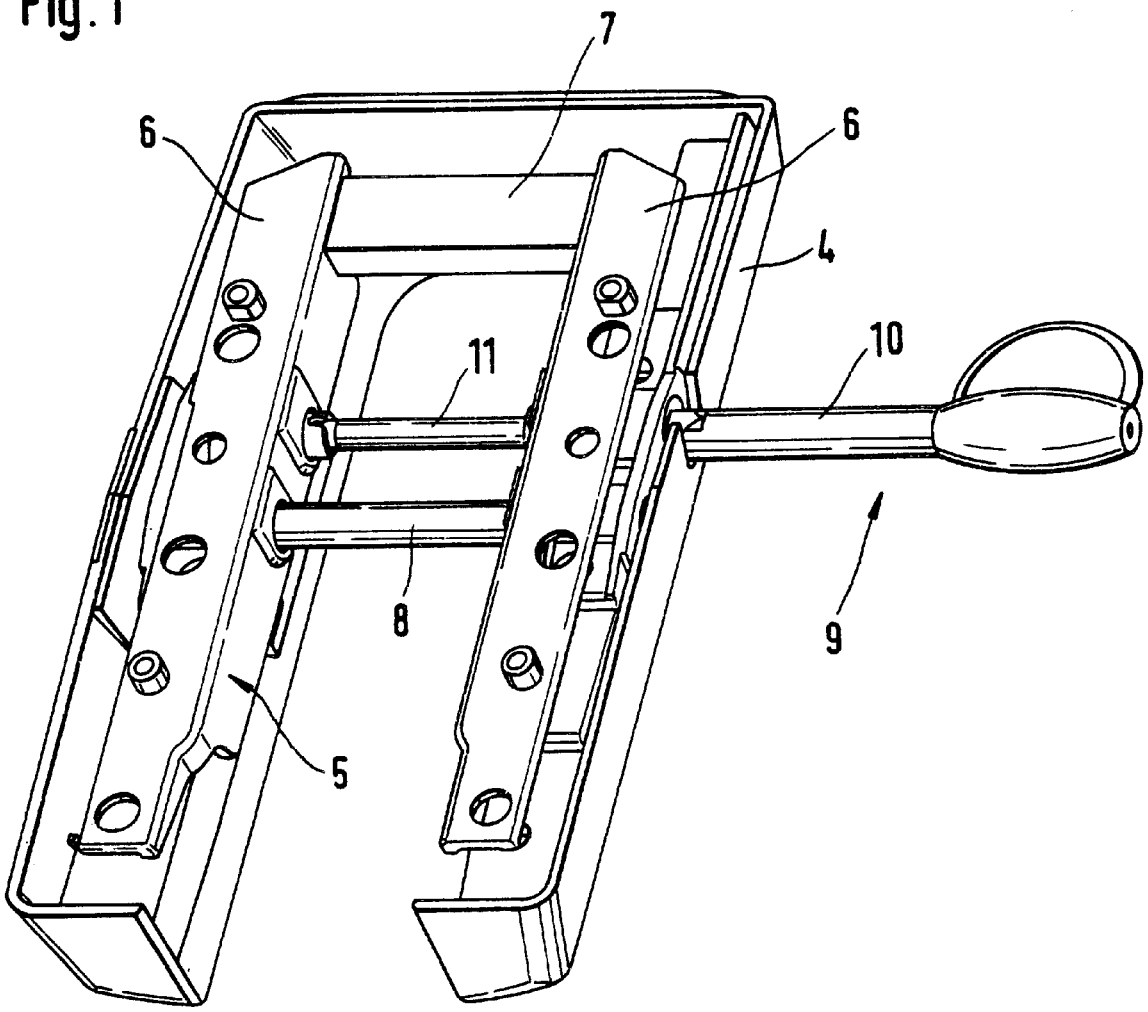
FIG. 1 shows in perspective representation the supporting frame of an office chair with a built-in seat tilt adjustment.

The supporting frame 4 of an office chair shown perspectively in FIG. 1 is preferably a diecasting molded part, in which the seat carrier 5 (comprised of the two lateral mounting slides 6 and the stationary crosshead 7) is incorporated in a tilt-adjustable manner. In the case of the example of embodiment shown, a cross-axle 8 is provided for this purpose approximately centrally in the seat carrier, and the end pieces of this axle are held in the supporting frame and on which cross-axle the seat carrier can be tilted (i.e., tipped) to the front or to the back.

The tilt of seat carrier 5 is adjusted each time by means of the cam rotating shaft 9 that is actuated manually. The rotating shaft 9 preferably includes manipulation part 10, which terminates approximately in the outer wall of supporting frame 4 in the representation according to FIG. 1 and functional part 11, which is found inside supporting frame 4, is connected thereon. In the example of embodiment shown, the functional part of the rotating shaft has on both sides, in the region of mounting slides 6 of the seat carrier, a concentric shaft part as the pivot bearing and an eccentric shaft part as the cam.

Figure 2:
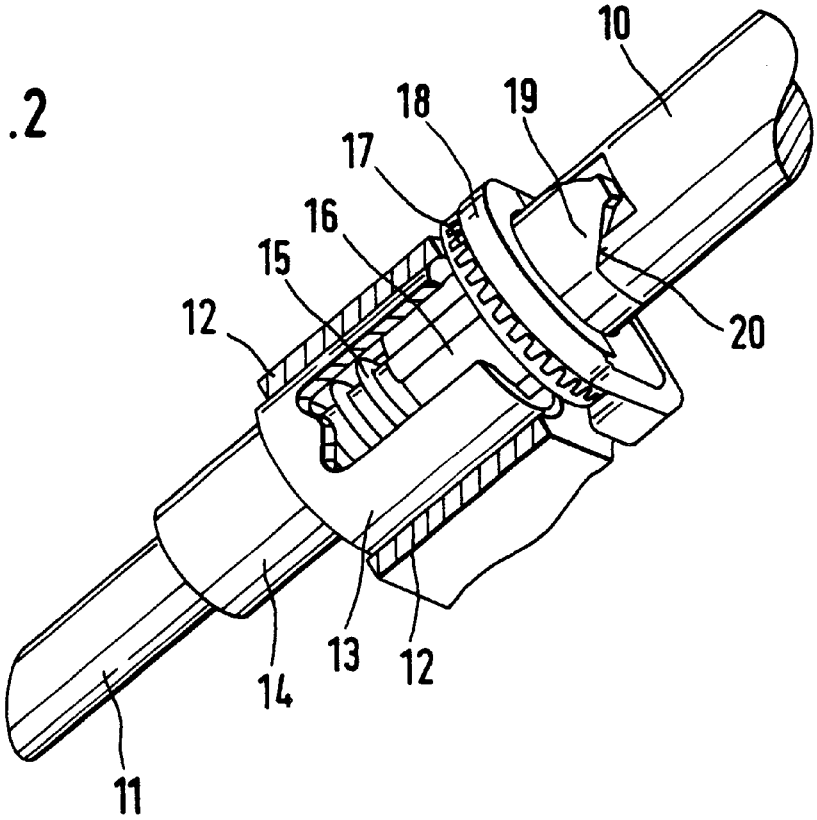
FIG. 2 shows the rotating shaft of the seat tilt adjustment in the non-actuated state.

FIG. 2 shows in more detail the pivot bearing present in FIG. 1 on the right side and the cam that is present therein. The pivot bearing, from which the upper covering is cut away for better discernibility, is represented by its two outer-lying bearing walls 12. These are shaped in a stationary manner in supporting frame 4. The concentrically designed shaft part 13 lies in this pivot bearing. The eccentrically designed shaft part 14, which runs in a cam bearing (not shown), which is present in the seat carrier 5, and whose eccentric throw controls the tilt adjustment of the seat carrier around its cross-axle or tipping axle 8 is connected thereon to shaft part 13.

A screw pressure spring or locking spring 15 is arranged in the concentrically designed shaft part 13, and this spring permanently presses an axial sliding bushing 16 with the toothed-wheel gearing 17 in the direction of the toothed-wheel gearing 18, which is positioned in a stationary manner on supporting frame 4. If manipulation part 10 of the rotating shaft is not actuated, then the disengageable locking catch, i.e. toothed-wheel gearings 17 and 18, are found in opposite engagement and block any undesired rotating angle adjustment of functional part 11 of rotating shaft 9.

Figure 3:
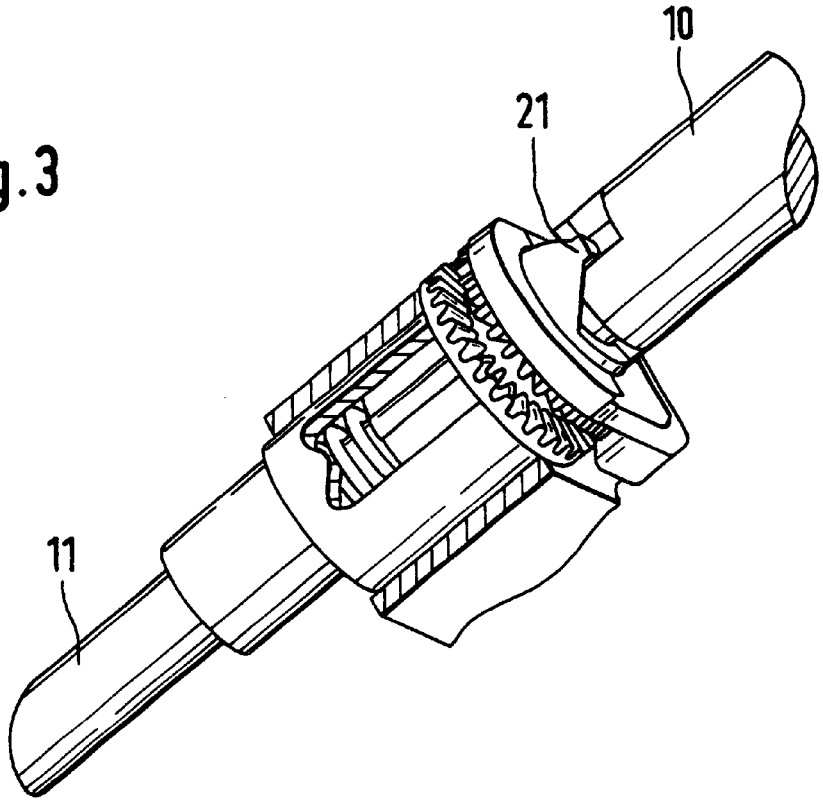
FIG. 3 shows the rotating shaft of the seat tilt adjustment in the actuated state.

If the manipulation part 10 of the rotating shaft is actuated around to the right according to the drawing, then the axial sliding bushing 16 with toothed-wheel gearing 17 is pressed back onto the rotating shaft against the pressure of locking spring 15 in a first rotating angle region by means of a change-over drive including starting bevels 19 and 20. Starting bevels 19 and 20 are preferably provided on the front-side bearing surfaces of manipulation part 10 and functional part 11 of the rotating shaft, in such a way that the toothed-wheel gearings 17 and 18 are disengaged, as shown in greater detail in FIG. 3.

At the end of the first rotating angle region, manipulation part 10 reaches the catch piece 21 (see FIG. 3), so that in the second rotating angle region, any other adjustment of the rotating angle of manipulation part 10 effects an analogous rotating angle adjustment of functional part 11 of the rotating shaft. The person seated in the seat then adjusts the eccentric throw for the tilt adjustment of the seat that he or she desires.

If the person seated in the seat terminates the adjustment of the rotating angle of manipulation part 10 of the rotating shaft, then locking spring 15 provides for an immediate and effective locking of the functional part of the rotating shaft to prevent any undesired further rotating angle displacement.

It will be understood that various modifications may be made to the embodiment disclosed herein. Therefore, the above description should not be construed as limiting, but merely as exemplifications of a preferred embodiment. Those skilled in the art will envision other modifications within the scope spirit of the invention.

What is claimed is:

1. An office chair having a seat carrier mounted around a horizontal and cross-running axis in a supporting frame so that it can be tilt-adjusted, said chair comprising:

a rotating shaft which includes a functional part having at least one concentric shaft part in a pivot bearing of the supporting frame, and at least one eccentric shaft part which runs in a cam bearing of the seat carrier, such that a rotating angle adjustment of the rotating shaft carried out by a person positioned on the seat changes the tilt of the seat carrier relative to the supporting frame, the rotating shaft further having a manipulation part, which can be rotated relative to the functional part of the rotating shaft;

a disengageable locking catch disposed between the functional part of the rotating shaft and supporting frame, constructed and arranged to block the rotating angle adjustment of the functional part of the rotating shaft in the non-disengaged state;

a change-over drive constructed and arranged such that a first rotating angle region of the rotating angle adjustment conducted by the person seated in the seat on the manipulation part of the rotating shaft is converted into a disengaging motion of the locking catch; and a catch piece constructed and arranged such that a subsequent second rotating angle region of the rotating angle adjustment conducted by the person seated in the seat on the manipulation part of the rotating shaft brings about an analogous rotating angle adjustment of the functional part of the rotating shaft by means of the catch piece between the manipulation part and the functional part of the rotating shaft;

wherein the locking catch is shaped in the form of a toothed-wheel gearing seated to be resistant to rotation on the functional part of the rotating shaft, and this gearing is engaged, in the non-disengaged state, with a toothed wheel gearing which is attached in a stationary manner to supporting frame, and that the toothed-wheel gearing sitting on the functional part of the rotating shaft can be disengaged by axial displacement on the rotating shaft against a pressure of a locking spring.

2. The office chair of claim 1, wherein the change-over drive is shaped in the form of one or more starting bevels, which are arranged on the supporting surfaces of manipulation part and functional part of the rotating shaft, which are on the front side lying opposite one another.

3. The office chair of claim 2, wherein the starting bevels are formed in both directions of rotation of the rotating shaft.

4. The office chair of claim 1, wherein the change-over drive is shaped in the form of one or more starting bevels, which are arranged on the supporting surfaces of manipulation part and functional part of the rotating shaft, which are on the front side lying opposite one another and the starting bevels are formed in both directions of rotation of the rotating shaft.

* * * * *